United States Patent [19]

Nooteboom

[11] Patent Number: 4,786,200

[45] Date of Patent: Nov. 22, 1988

[54] BINDER STRIP FOR BINDING LOOSE PERFORATED LEAVES

[75] Inventor: Cornelis P. Nooteboom, Hoogezand, Netherlands

[73] Assignee: Atlanta Hoogezand B.V., Hoogezand, Netherlands

[21] Appl. No.: 41,545

[22] Filed: Apr. 23, 1987

[30] Foreign Application Priority Data

May 22, 1986 [EP] European Pat. Off. ..... 86200898

[51] Int. Cl.[4] ..... B42F 13/06; B42F 13/14; B42F 9/00

[52] U.S. Cl. ..... 402/16; 402/14; 402/15

[58] Field of Search ..... 402/14, 15, 16; 281/21 R, 24, 26

[56] References Cited

U.S. PATENT DOCUMENTS 3,285,250 11/1966 Ivory et al. ..... 402/16
3,746,457 7/1973 Comenitz ..... 402/16

FOREIGN PATENT DOCUMENTS 297260 5/1915 Fed. Rep. of Germany ..... 402/16
361017 5/1906 France ..... 402/16

OTHER PUBLICATIONS

Data-Lok Brochure by Red Rope Industries Inc., Bristol, Pa., 19007—Oct. 10, 1972.

*Primary Examiner*—E. R. Kazenske
*Assistant Examiner*—Paul M. Heyrana, Sr.
*Attorney, Agent, or Firm*—Fleit, Jacobson, Cohn & Price

[57] ABSTRACT

A binder strip for binding loose leaves having perforations therein through which flexible wires can be inserted. The binder strip comprises a substantially U-shaped rail having holes in its bottom surface for the passage of said wires, and the rail is provided at least at one end with a clamping member pivotally connected to the rail and in operative position accommodated by the rail for the clamping down a wire, said clamping member being formed in one integral part with said rail and with a flexible bridge member joining said rail and said clamping member and providing for pivoting action.

2 Claims, 1 Drawing Sheet

IV
IV

BINDER STRIP FOR BINDING LOOSE PERFORATED LEAVES

This invention relates to a binder strip for binding loose leaves having perforations therein through which flexible wires can be inserted, comprising a substantially U-shaped rail having holes in its bottom surface for the passage of such wires, said rail being provided at least at one end with a clamping member pivotally connected to the rail and in operative position accommodated by said rail for clamping down a wire.

Similar binder strips are disclosed in U.S. Pat. No. 3,746,457. In these prior binder strips, the clamping member is pivotally connected to the substantially U-shaped rail by means of pivot pins secured to the clamping member and mounted for rotation in bores of the U-shaped rail. Such a two-part construction has a number of disadvantages. First the two parts of the binder strip must be separately produced, which results in additional cost of production and storage. Second, the construction is such that one or both parts, before they can be assembled to form the binder strip, must be subjected to extra after-treatments, for example, making the bores for the pivot pins. As a third objection can be mentioned that the two parts must be assembled prior to use. This assembly increases the cost price of the binder strip. For the matter of that, the binder strip may alternatively be constructed so that the user can carry out the assembly. This does reduce cost, but adds the drawback that parts may become lost prior to assembly.

It is an object of the present invention to obviate the disadvantages outlined above.

For this purpose, according to the invention, the binder strip of the above kind is characterized by said rail and said at least one clamping member being made in one integral part together with a flexible bridge member joining said rail and said clamping member, which bridge member provides for pivot action.

One embodiment of the invention will now be described, with only one end being shown since both ends have the same structure, by way of example, with reference to the accompanying drawings, in which FIG. 1 shows an embodiment of a binder strip in accordance with the present invention, in an open condition and with a wire extending through a bore;

Figures 1, 2, 3, 4:
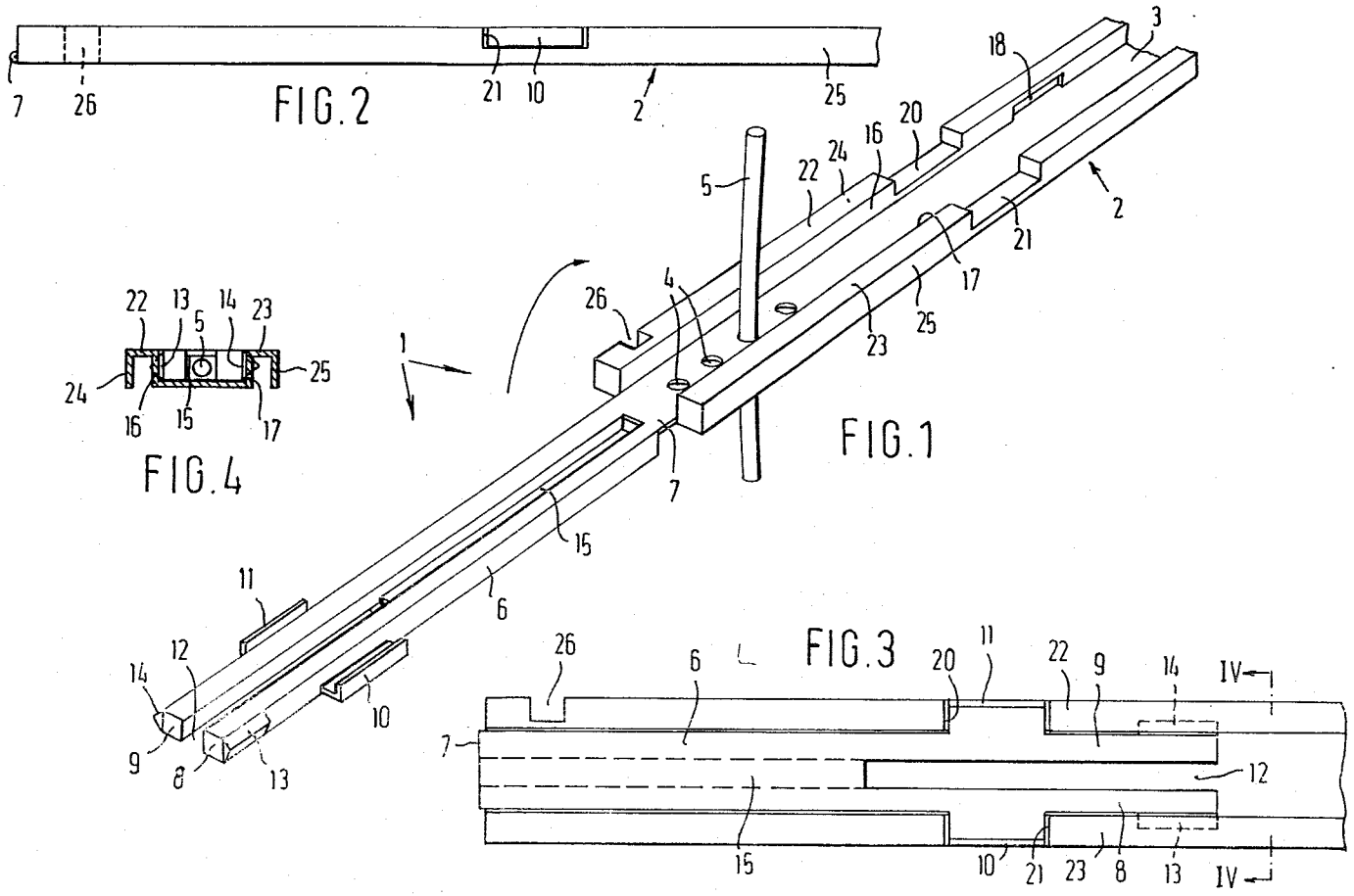
FIG. 2 shows a side-elevational view of the binder strip of FIG. 1 in the closed condition.
FIG. 3 shows a top plan view of the binder strip of FIG. 1 in the closed condition.
FIG. 4 shows a cross-sectional view of the binder strip, taken on the line A—A of FIG. 3.

FIG. 1 shows an embodiment of a binder strip according to the present invention. The strip is generally indicated at 1 and comprises a rail member 2 having a substantially U-shaped cross-sectional configuration. Formed in the bottom 3 of rail member 2 are bores 4 for permitting the passage of a wire. One such wire is shown at 5 and extends through one of the bores 4. Rail member 2 terminates without any interruption into a clamping member 6 through a pivoting bridge member 7. The pivot action of bridge member 7 is obtained by making bridge member 7 thinner. It will be clear, for that matter, that the pivot action of the bridge member can be obtained otherwise, for example by providing suitable moulding, without departing from the scope of the invention.

Clamping member 6, which is designed to flex and clamp the part of a wire extending through a bore 4 of rail 2 terminates at its free end into two legs 8,9. Provided on these legs are laterally projecting thrust faces 10,11, by means of which legs 8,9 can be resiliently pressed together somewhat, thereby narrowing their interspace 12. The interspace also serves to receive and confine the wire as the binder strip is closed to prevent the wire from being deflected sideways. Provided at the end of legs 8,9 are outwardly extending lugs 13,14.

The operation of the binder strip is as follows. When the wire 5 has been inserted through a bore 4, the clamping member 6 can be pivoted in the direction of rail member 2 by means of the pivotal bridge member 7, which in the embodiment shown is of reduced thickness. As it is moved further, clamping member 6 contacts wire 5, which will thereby be bent around the boundary of bore 4. To prevent wire 5 from being deflected sideways its end can be received in the interspace 12 between legs 8,9. The wire is in addition accommodated in a groove 15 of clamping member 6. Ultimately lugs 13,14 of legs 8 and 9 will come into contact with legs 16,17 of rail member 2. When pressure is now exerted on the two thrust faces 10 and 11, legs 8 and 9 and hence lugs 13 and 14 will be moved towards one another so that clamping member 6 can be moved further into rail member 2. Formed in legs 16, 17 of the rail members are holes 18,19 at the level of the lugs of the 'closed' clamping member 6. By removing the pressure from thrust faces 10,11, legs 8,9 and hence lugs 13,14 will again move apart. Lugs 13,14 will then fit into holes 18, 19 so that clamping member 6 and hence also the wire will be fixed relatively to the rail member. For the laterally projecting thrust faces 10,11, too, recesses 20, 21 are formed in legs 16,17. Thrust faces 10,11 and recesses 20,21 are designed so that, as shown in FIGS. 21 and 3, thrust facs 10,11 fit entirely within the contour of rail member 2. Clamping member 6 is further designed so that, in the closed condition, its upper surface is co-planar with the upper surface of legs 16,17 of rail member 2. Accordingly, the binder strip has no projecting parts. This makes it possible for an array of binder strips to be stacked or suspended in a relatively compact formation.

As shown in FIG. 4, legs 16,17 are formed at the top with outwardly extending flanges 22,23, extending parallel to bottom surface 3, which in turn, have downwardly extending flanges 24,25, parallel to legs 16, 17. These flanges 22, 23 and 24, 25, which together form a reinforcing edge, reinforce rail member 2 and in addition camouflage recesses 18,19 and lugs 13,14. The same can be achieved, for that matter, by making legs 16, 17 fully solid and broader.

At least one of the reinforcing edges is formed with a recess 26 adjacent to the end of the rail member by means of which the binder strip can be suspended in rack.

The binder strip, consisting of the rail member, the pivoting bridge member and the clamping member is made of fully 'releasing' design, so that it can be manufactured in one operation, in particular by injection moulding. A material highly suitable for its manufacture is polypropylene. This material not only has good injection moulding characteristics, as has turned out, for example, from prior similar applications, but in addition has good fatigue characteristics which are particularly of importance for the pivoting bridge member and the compressable legs 8,9 of clamping member 6. The binder strip can thus be made in one piece, which makes for relatively low cost, and avoids such problems as manufacturing and stocking several parts, assembly and the loss of loose parts.

The end of the wire 5 projectng through rail member 2 that is not secured by clamping member 6 is inserted through loose leaves of paper, or the like, not shown, from one face thereof and is secured by another binder strip 1 at the opposite face of the loose leaves.

It is noted that various modifications of the binder strip described herein will readily occur to those skilled in the art. Thus, for example, the thrust face and the lug of a leg of the clamping member can be combined or provided on the legs of the clamping member at the same level, thereby reducing the necessary length of the clamping member. These and similar modifications can be made without departing from the scope of the present invention.

I claim:

1. A binder strip for use in binding loose leaves, having perforations therein through which flexible wires can be inserted, comprising a substantially U-shaped rail having a bottom surface with spaced apart holes therethrough to permit flexible wires to be inserted therethrough and a leg extending from each side of the bottom surface, a recess in each leg at an edge thereof remote from the bottom surface and a recess in each leg in an inside wall thereof;

a clamping member formed integrally with and comprising a continuation of the bottom surface and with a section of the clamping member adjacent to the rail being formed to be a flexible bridge section whereby the clamping member will bend to overlie the rail, and said clamping member has a wire receiving groove extending longitudinally therein along a central longitudinal axis of the clamping member for a portion of the length of the clamping member, a pair of spaced apart legs extending from about the wire receiving groove to the end of the clamping member, a thrust face intermediate the length of each leg to provide means for moving said legs together and each positioned to fit into the recess in a leg of a rail that is remote from the bottom surface, and a lug adjacent the end of each leg, each lug to fit into one of said recesses formed in the inside walls of the legs of the rail.

2. A binder strip as in claim 1 wherein the flexible bridge section is made of the same material as the rail and clamping member but of a reduced thickness to facilitate bending thereof.

* * * * *